United States Patent [19]

Bourgoin

[11] 4,176,500

[45] Dec. 4, 1979

[54] SPRINKLING DEVICE FOR GRINDING WHEELS

[75] Inventor: Bernard Bourgoin, Saint Etienne, France

[73] Assignee: Centre Technique des Industries Mecaniques, France

[21] Appl. No.: 836,007

[22] Filed: Sep. 23, 1977

[30] Foreign Application Priority Data

Sep. 24, 1976 [FR] France ..... 76 28732
Sep. 13, 1977 [FR] France ..... 77 27573

[51] Int. Cl.[2] ..... B24B 55/02
[52] U.S. Cl. ..... 51/267
[58] Field of Search ..... 51/267, 266

[56] References Cited

U.S. PATENT DOCUMENTS

| | | | |
|---|---|---|---|
| 3,123,950 | 3/1964 | Kuris et al. | 51/267 |
| 3,256,647 | 6/1966 | Hutton | 51/267 |
| 3,334,451 | 8/1967 | Hutton | 51/267 |

*Primary Examiner*—Robert L. Spruill
*Assistant Examiner*—Roscoe F. Parker
*Attorney, Agent, or Firm*—Holman & Stern

[57] ABSTRACT

Droplets of cooling fluid which have been projected from a grinding or cutting wheel under the action of centrifugal force are returned to the wheel by means of teeth or grooves formed in that surface of a deflecting shoe which is located opposite to the active surface of the wheel. Means are provided for adjusting the curvature of the deflecting surface according to the diameter of the wheel.

6 Claims, 9 Drawing Figures

VIII
VIII
46
87
86
84
81
18
49
93
22
82
83
24
42
24A
2

IX
IX
14
89
88
81
86
87
46
20
18
49
93
22
82
83
91
24
D
A
42
2
84

SPRINKLING DEVICE FOR GRINDING WHEELS

This invention relates to fluid sprinkling devices for grinding wheels and like tools, of the type comprising a deflecting shoe in which the surface located opposite to the active surface of the grinding wheel has teeth or grooves oriented substantially at right angles to the displacement of the active surface of the wheel in order to return the grinding fluid towards said wheel.

Especially when grinding wheels operate at high speed, namely at over 40 meters per second approximately, it is very useful to ensure that the clearance space between the shoe of the grinding wheel has a well-determined value which varies between 0.5 and 1.5 mm in the majority of instances. In order to take this condition into account, it has already been proposed to provide means for adjusting the position of the shoe with respect to the grinding wheel, thus making it possible to move the shoe towards the wheel progressively as wear of this latter takes place in order to restore said clearance space to its initial width.

However, in the case of a cylindrical or profiled grinding wheel which works at its periphery, a reduction in diameter of the wheel as a result of wear is accompanied by a reduction in radius of curvature of said wheel; in consequence, even if the shoe is moved towards the wheel spindle, the extremities of the arc of the shoe will be located at a slightly greater distance from the wheel than the apex of the arc since its radius of curvature will not have changed whereas that of the wheel will have been reduced. In point of fact, this irregularity in width of the clearance space between the shoe and the wheel impairs the cooling efficiency.

The aim of the invention is to improve the devices aforesaid with a view to overcoming this disadvantage.

To this end and in accordance with the invention, means are provided for adjusting the curvature of the deflecting surface of the shoe according to the diameter of the grinding wheel.

By virtue of this particular arrangement, the clearance space between the grinding wheel and the active surface of the shoe can be maintained at a constant optimum value over the entire length of said shoe.

A more complete understanding of the invention will be obtained from the following detailed description and from the accompanying drawings in which a number of embodiments of the invention are shown by way of example without any limitation being implied, and in which.

Figure 1:
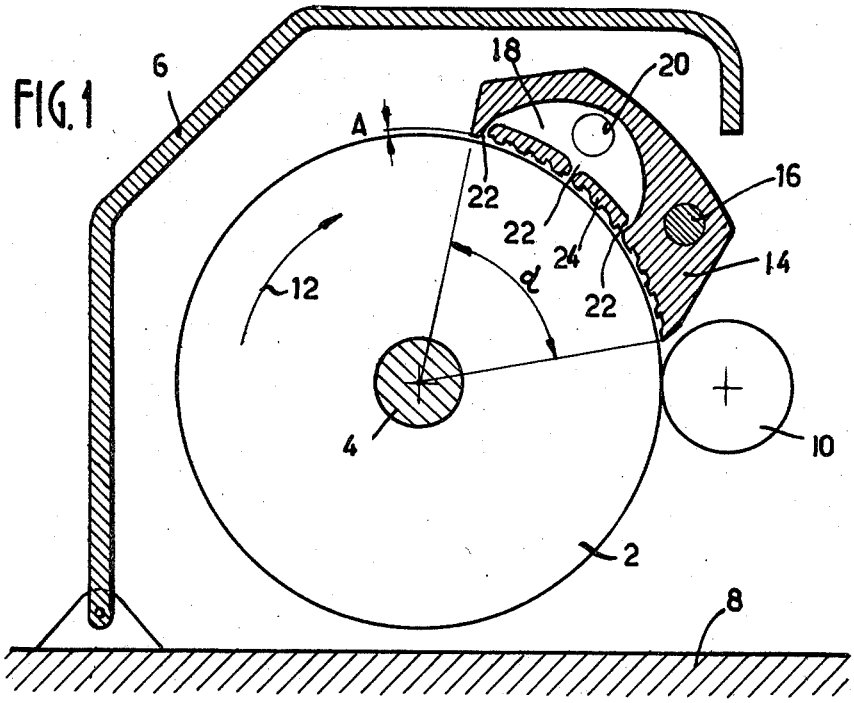
FIG. 1 is a diagrammatic view of the grinding fluid supply device in accordance with the invention as applied to a cylindrical wheel for grinding between centers.

There is shown in FIG. 1 a grinding wheel 2 which is carried by the spindle 4 of the machine. A wheel guard 6 is fixed or pivotally mounted on the frame 8 of the grinding machine or alternatively with respect to the axis of the grinding wheel. The workpiece to be ground is shown at 10 and the direction of rotation of the wheel 2 is shown by the arrow 12.

In this embodiment, the deflecting shoe 14 has the shape of a sector which closely follows the circumference of the wheel over a sector $\alpha$ of approximately 60° to 70°, the clearance space A between the grinding wheel and those surfaces of the shoe which are nearest the wheel being of the order of 0.5 to 2.5 mm and preferably not in excess of 1.5 mm.

The shoe 14 is maintained in a stationary position with respect to the grinding wheel by fastening means 16 which secure the shoe to the frame 8 of the grinding machine or else to the wheel guard as will be explained in connection with FIG. 3.

The shoe 14 is constituted by a hollow body containing a chamber 18 into which opens an inlet 20 for the admission of grinding fluid which is supplied at a moderate pressure such as 0.5 to 1 bar for example by means of a supply installation (not shown in the drawings). The chamber 18 communicates with the clearance space A between the shoe and the wheel by means of one or a number (three, for example) of liquid discharge apertures 22.

Figure 2:
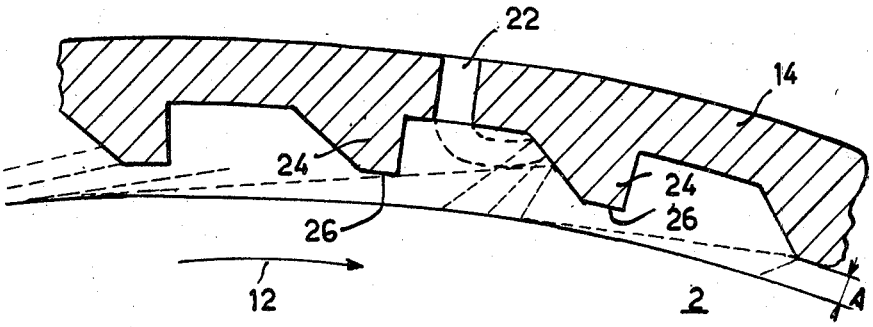
FIG. 2 is a partial view to a large scale showing the deflecting action of the shoe and of its teeth on the grinding fluid.

Depending on the form of construction to which preference is given, that surface of the shoe 14 which is located opposite to the active surface of the wheel is provided with grooves between which are formed teeth 24 (as also shown in FIG. 2), said teeth being oriented substantially at right angles to the displacement of the active surface of the wheel.

The liquid discharge apertures 22 have their openings within the clearance space A in the bottom lands of the teeth 24.

FIG. 2 shows in dashed lines the circulation of the grinding fluid between the shoe and the wheel. The cross-section of FIG. 2 is limited to the central portion of the shoe which is provided with the intermediate aperture 22 for the discharge of fluid from the shoe.

The grinding fluid which is fed against the wheel through the apertures 22 is discharged from said wheel under the action of centrifugal force and tangentially to this latter. However, the top lands 26 of the teeth have a wiredrawing action on the grinding fluid and at the same time produce a rupture of the air layer. By virtue of this wiredrawing action between grinding wheel and shoe and by virtue of the multiple baffles formed by the teeth 24, the result thereby produced is an acceleration of the grinding fluid droplets which are returned against the wheel several times in succession, with the result that perfect removal of waste material is achieved as explained earlier.

It is apparent that this device produces a hydraulic braking action on the grinding wheel. Thus, in respect of an input power of 1300 W at the spindle motor with a conventional grinding fluid supply system, it has been observed that the addition of the sprinkling shoe resulted in a power increase of 40 W but this small power increase is compensated by the efficiency of the device to a very substantial extent.

A further advantage of this system lies in the overall wheel-cooling efficiency. Thus the grinding wheel operates constantly at the temperature of the grinding fluid as it has been possible to ensure by checking the diameter of the wheel by means of a pneumatic micrometer.

In some applications and especially in cutting with a disc-type wheel, the wear of the wheel can be relatively rapid in spite of the efficiency of the device in accordance with the invention. For this reason it can prove advantageous to provide a device for advancing the sprinkling shoe so as to maintain a constant interval between the deflecting surface of the shoe and the active surface of the grinding wheel.

Figure 3:
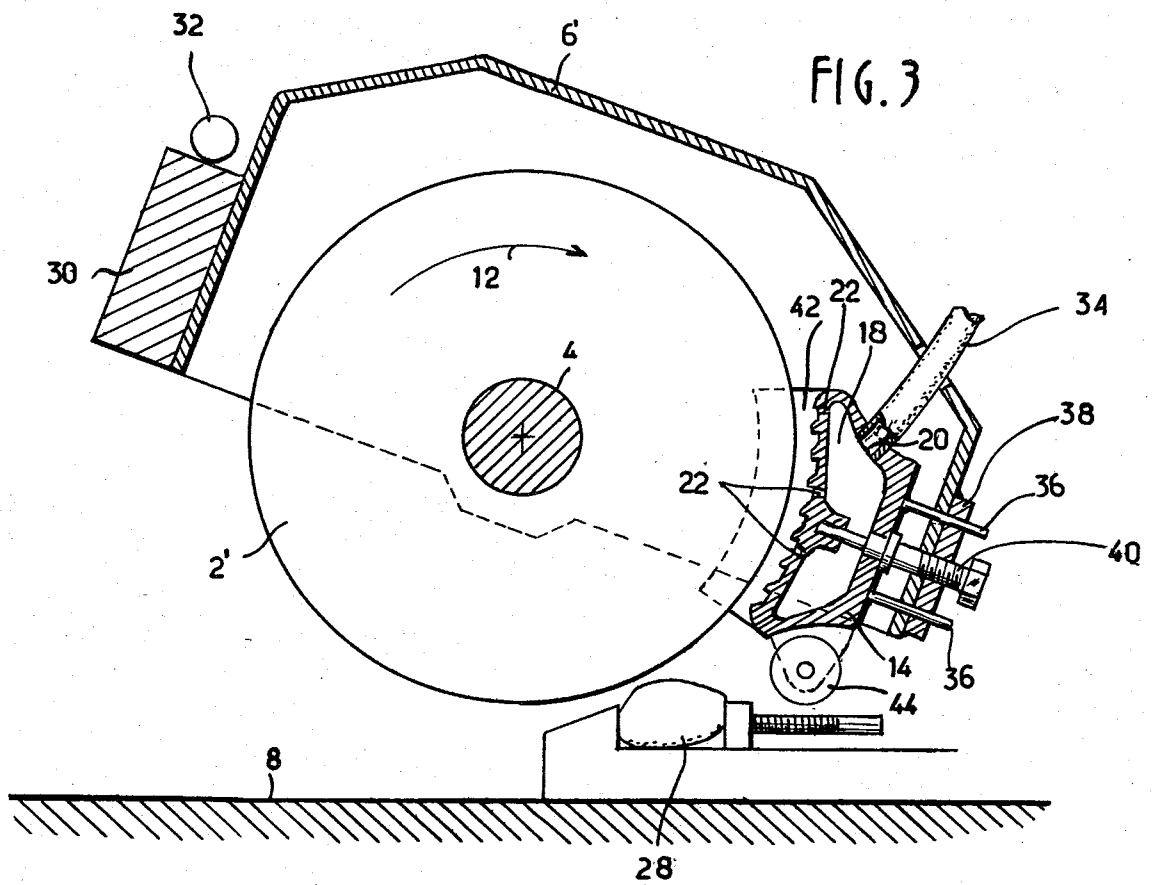
FIG. 3 shows a grinding fluid supply device provided with a system for adjusting the advance of the shoe with respect to the grinding wheel.

FIG. 3 shows an arrangement of this type as applied to a cutting disc 2' for cutting workpieces 28. In this embodiment, the wheel guard 6' is pivotally mounted on the wheel spindle 4 and the sprinkling shoe 14 is supported by the guard casing. Provision can be made on the other side of said guard casing for a balance-weight 30, a fixed stop 32 which is rigidly fixed to the frame 8 of the grinding machine in order to limit the pivotal movement of the assembly consisting of wheel guard and shoe.

The orifice 20 for the admission of cutting fluid into the internal chamber 18 of the shoe 14 is joined to a flexible pipe 34 which is connected to the cutting fluid feed pump.

The shoe 14 is fixed on the wheel guard 6' in an adjustable position so as to be capable of sliding radially with respect to the grinding wheel. In the embodiment shown in FIG. 3, the shoe has two displacement guide stems 36 slidably mounted in a plate 38 which is rigidly fixed to the wheel guard 6'. A screw 40 fitted within an internal screw-thread of the plate 38 and made fast for translational motion with the shoe 14 serves to advance the shoe towards the grinding wheel progressively as this latter becomes subject to wear in order to maintain the interval which exists between the grinding wheel and the shoe at a substantially constant value which is the most conducive to efficiency of the fluid sprinkling device irrespective of the wheel diameter.

The shoe is preferably provided on both sides with lateral cheeks 42 which partly surround the grinding wheel and guide the cutting fluid.

Provision can advantageously be made on the shoe or on the pivotal wheel guard 6' for a copying key or copying roller 44 which produces the pivotal movement of the guard-shoe assembly according to the profile of the workpiece to be cut. The cutting fluid is thus constantly brought as close as possible to the workpiece to be cooled during the cutting operation.

In addition to the system for advancing the sprinkling shoe along the radius of the grinding wheel as described in the foregoing, it is also an advantage to provide a system for correcting the arc of the shoe progressively as the wheel diameter decreases as a result of wear. This correcting system makes it possible to maintain constant efficiency of the fluid sprinkling device, especially as adjustment of the advance of the shoe and correction of its curvature can be combined as will be explained in connection with FIGS. 4 and 5.

In these embodiments, the sector 45 of the shoe 14 which surrounds the grinding wheel is constituted by a flexible metal strip in which the teeth 24 and the liquid discharge apertures 22 have been cut.

Figure 4:
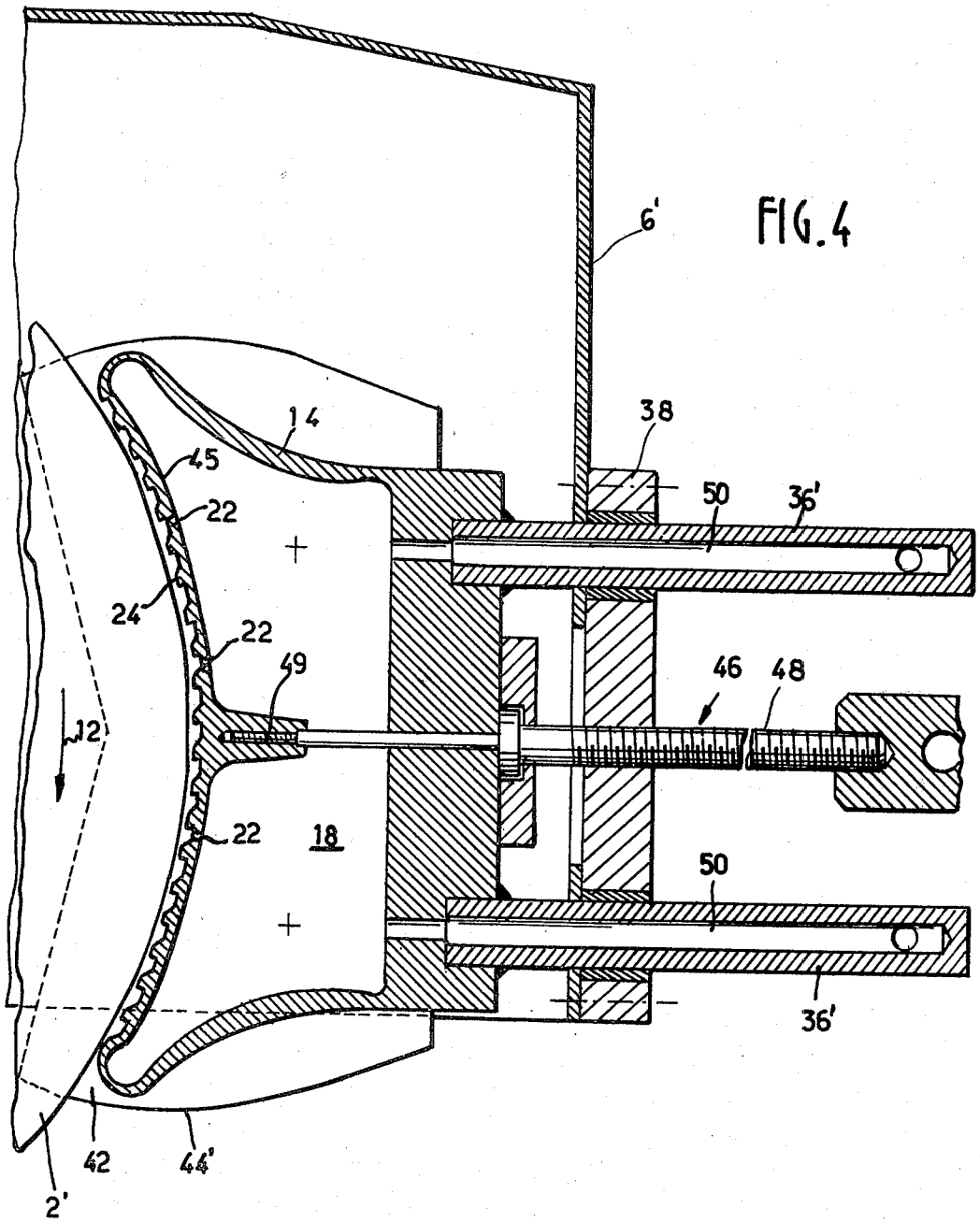
FIGS. 4 and 5 show two alternative embodiments of the adjusting system of FIG. 3 in which means are combined for adjusting the curvature of the shoe.

In the case of FIG. 4, the advance of the shoe and the control of deformation of the arc are carried out simultaneously by means of a single screw 46 having two threaded portions 48 and 49 of either equal or different diameter, the screw threads of which are inclined in the same direction but have different pitches. In this case, the permanent deformation of the arc of the sector 45 corresponds to the diameter of a new grinding wheel.

The grinding fluid can be admitted into the internal chamber 18 of the shoe through bores 50 which are pierced in the sliding guide rods of the shoe.

The copying roller 44 shown in FIG. 3 can be replaced by a convex shape 44' shown is given either to the shoe 14 or to the lateral cheek 42, this convex portion being intended to rest on the profile of the workpiece to be cut and to produce pivotal motion of the guard-shoe assembly about the axis of the grinding wheel.

Figure 5:
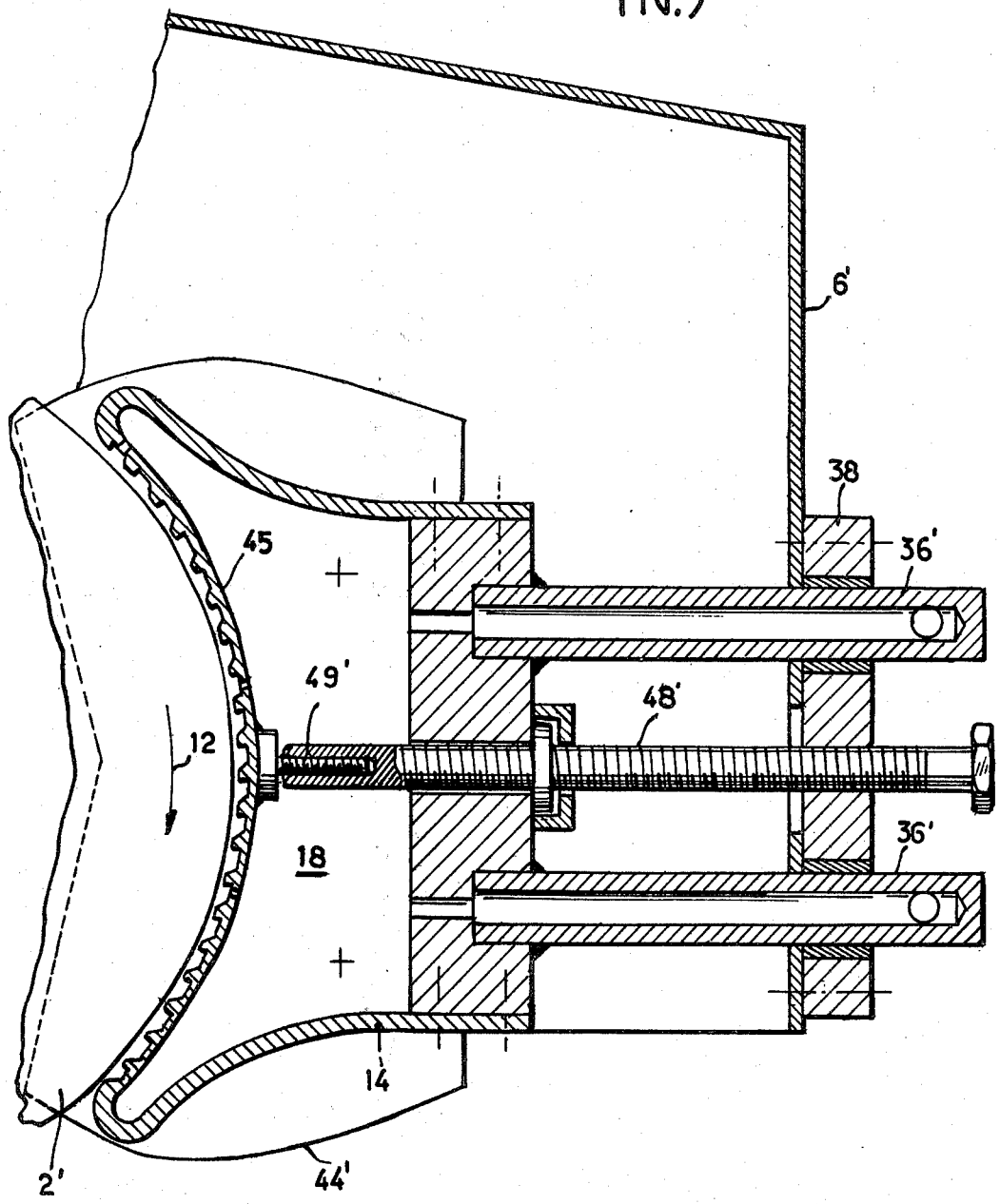

FIG. 5 shows another embodiment of the combined adjustment of advance of the grinding wheel in conjunction with the variation of arc of the sprinkling shoe by means of differential screws.

A first screw 48' controls the advance of the shoe on the radius of the grinding wheel 2' whilst a second screw 49' having a different diameter and different pitch is fitted within the advance-control screw 48' and the direction of the helix of the two screw-threads is the same.

This system of differential screws therefore also permits simultaneous combination of the two adjustments described in the foregoing.

Figure 6:
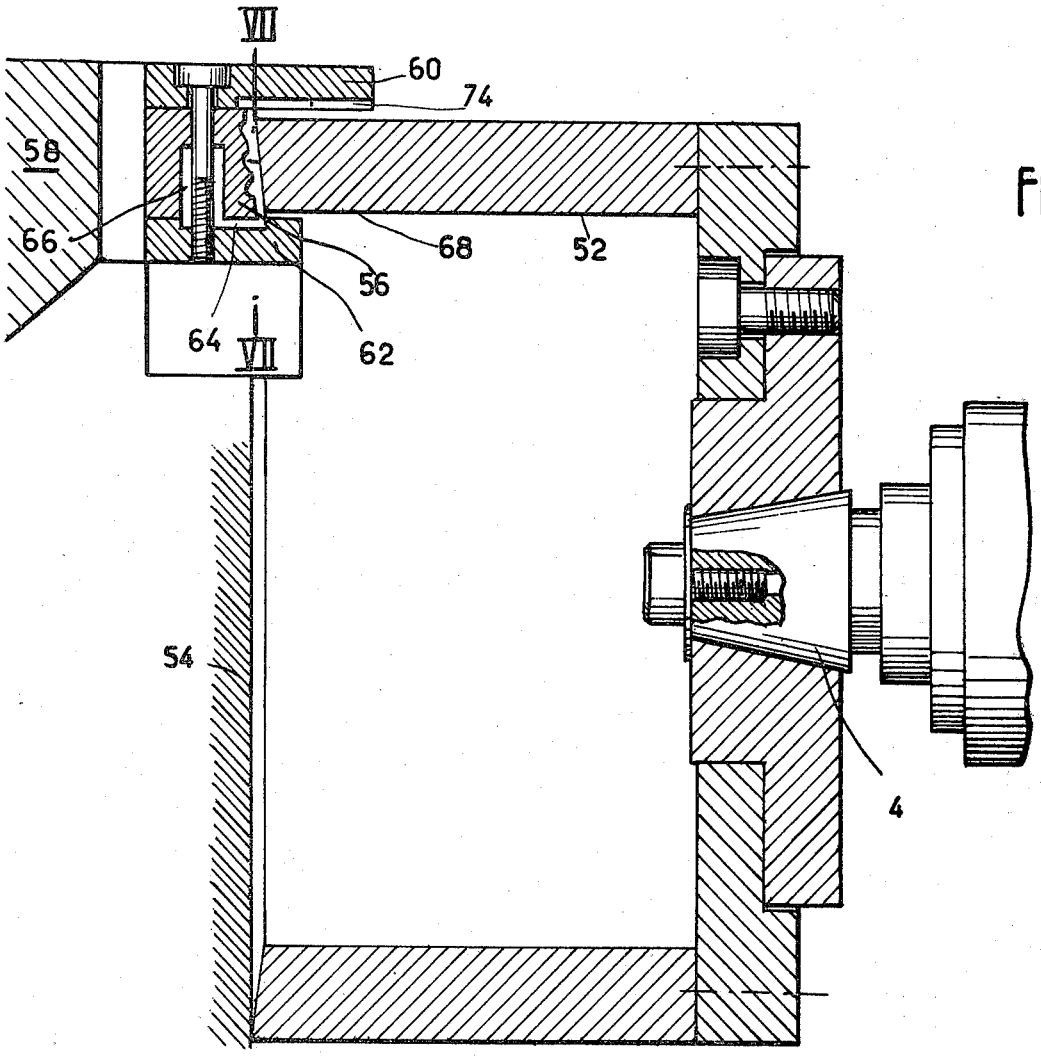
FIG. 6 is an axial sectional view of a device in accordance with the invention as applied to a cup wheel.
Figure 7:
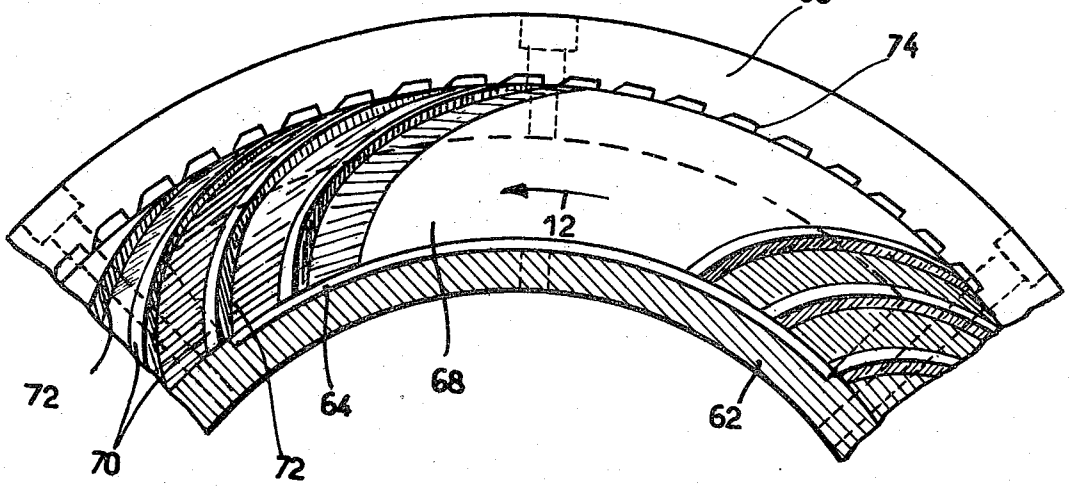
FIG. 7 is a part-sectional view taken along line VII—VII of FIG. 6.

FIGS. 6 and 7 relate to the application of the device in accordance with the invention to a cup wheel 52 which is supported by the wheel spindle 4. The work zone is indicated by the shaded area 54.

The sprinkling shoe 56 carried by a support 58 can surround the grinding wheel over a sector of 60° to 90° and preferably 80°. Two lateral cheeks 60 and 62 which are secured to the shoe serve to recover the grinding fluid.

The supply of fluid is carried out from the small diameter or internal diameter of the grinding wheel through a slit or orifices 64 which communicate with the internal chamber 66 of the shoe.

The front portion 68 of the shoe which is located opposite to the active surface of the grinding wheel and constitutes the fluid-deflecting surface is provided with teeth having the same functions as the teeth of the shoes 14 described earlier in connection with cylindrical grinding or cutting.

Preferably and as shown in FIG. 7, the teeth aforesaid are curved and advantageously have the shape of an epicycloid, the epicycloids being cut in opposition to the projection of fluid droplets resulting from the action of centrifugal force. In FIG. 7, the lines 70 represent the top lands of the teeth whilst the lines 72 represent the bottom lands of said teeth.

In order to clean the external diameter of the grinding wheel, the upper lateral cheek 60 carries a set of teeth 74 which is identical with that of the shoe 14 shown in FIGS. 1 to 4. This cheek therefore performs the same function as a sprinkling shoe but the position of this sprinkling shoe is stationary by reason of frontal wear of the grinding wheel.

In comparison with a conventional sprinkling system, the device in accordance with the invention has made it possible to increase the grinding ratio "G" from 400 to 1200%, depending on the conditions of machining.

Traces of browning and crack formation are prevented. More accurate control of dimensions and tolerances on the machined workpiece as well as the state of surface is accordingly achieved.

Figure 9:
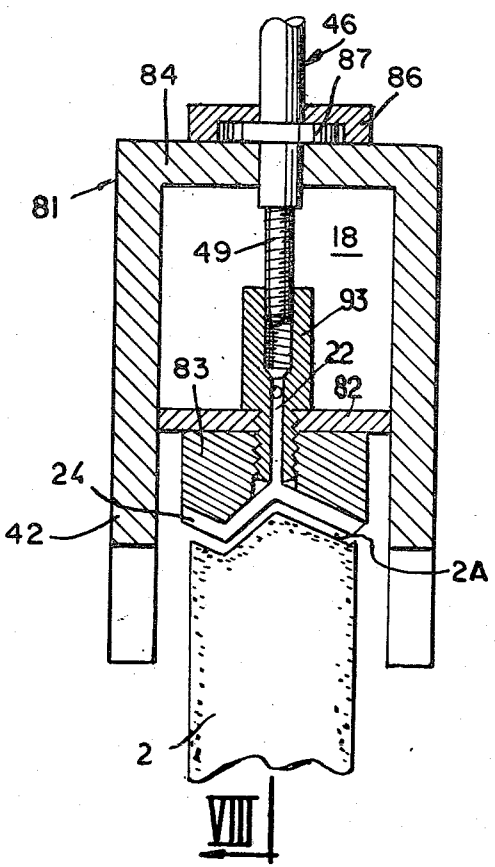
FIG. 9 is a sectional view taken along a plane which passes through the axis of the grinding wheel, this view being taken along line IX—IX of FIG. 8.
Figure 8:
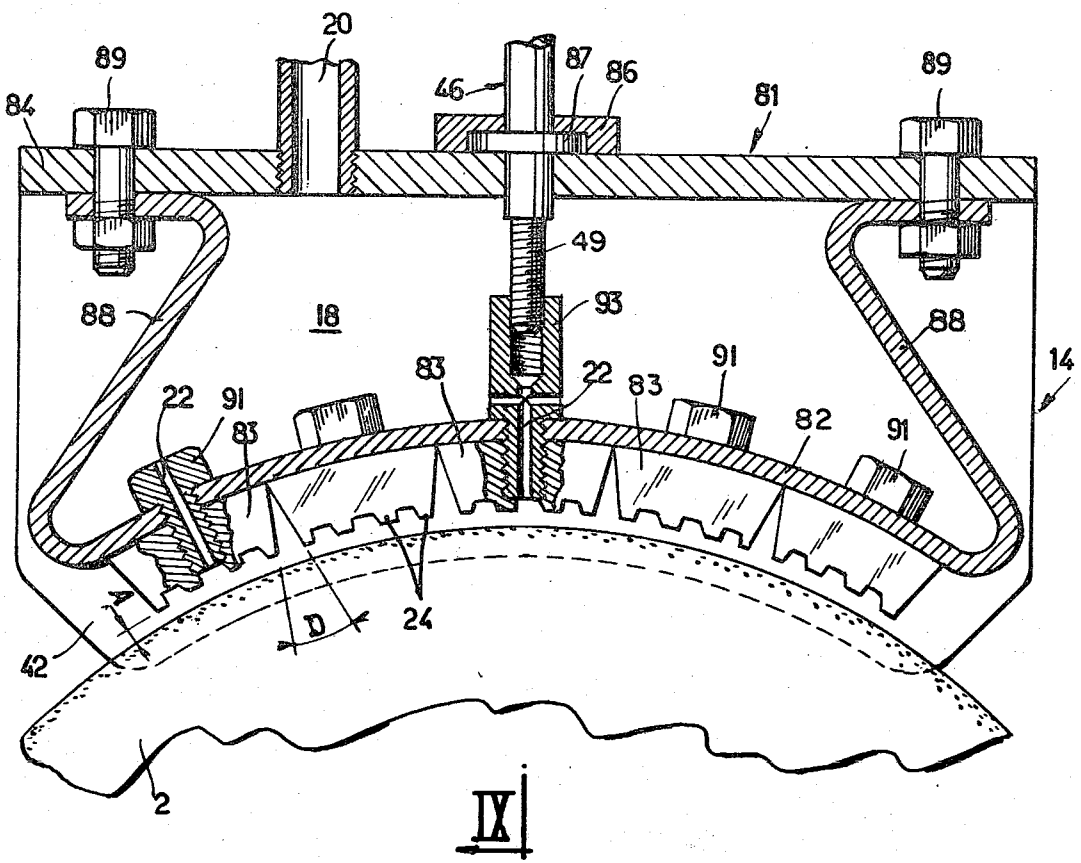
FIG. 8 is a sectional view of the device taken along a plane at right angles to the axis of the grinding wheel, this view being taken along line VIII—VIII of FIG. 9.

FIG. 8 is a sectional view of the device along a plane at right angles to the axis of the grinding wheel and along line VIII—VIII of FIG. 9 whilst FIG. 9 is a sectional view taken along a plane which passes through the axis of the grinding wheel, this view being taken along line IX—IX of FIG. 8.

The fluid sprinkling device of the grinding wheel 2 which is partially illustrated in FIGS. 8 and 9 comprises a shoe which is generally designated by the reference 14 and constituted by a support 81, a strip 82 and blocks 83.

The support 81 is a rigid member which is carried by the wheel guard (not shown) in order to permit displacement either towards or away from the grinding wheel 2 by any suitable means such as, for example, the screw system described and illustrated in FIG. 4. There can be seen in FIGS. 8 and 9 the extension of said screw 46 which is positioned axially with respect to the support 81 by means of a flange 86 which is fixed on said support and imprisons an annular collar 87 of the screw extension.

The strip 82 is an elastically deformable member of steel, for example, having a curvature which follows the cylindrical surface of the grinding wheel at a predetermined distance from this latter. Said strip has two angled extensions 88 and is secured to the rigid support 81 by means of said extensions and two bolts 89.

The blocks 83 are rigid parts of stainless steel or bronze for example and having the shape of ring segments which are coaxial with the grinding wheel but the short sides of which form an acute angle "D" between two adjacent blocks. Said blocks can thus be moved towards each other to a slight extent in order to reduce the radius of curvature of the general deflecting surface formed by the series of active internal cylindrical surfaces of said blocks. By means of a screw 91, each block 83 is fixed against that cylindrical face of the strip 82 which is directed towards the grinding wheel. The teeth of the active faces of the blocks are again designated by the reference 24.

The rigid support 81 is constituted by a U-section member, the flanges of which constitute cheeks 42 for lateral guiding of the deformable strip 82 and form the chamber 18 in conjunction with said strip. Said chamber is connected on the one hand to a duct 20 for the supply of water under pressure and on the other hand to ducts which have their openings in the grooves of the active surfaces of the rigid blocks and which are constituted in this example by axial holes 22 formed in the screws 91 for securing said blocks.

As in the embodiment shown in FIG. 4, the means for controlling the modification of the radius of curvature of the strip 82 are constituted by a screw 49 which is integral with the screw 46 for controlling the advance and withdrawal of the shoe 14, said screw 49 being engaged within a nut 93 which is rigidly fixed to said strip. In the example shown, said nut is formed by the specially designed head of the fixing screw of one of the blocks 83.

The operation is as follows:

When the grinding wheel is new, the radius of curvature of the strip 82 is such, for example, that the active surfaces of all the blocks 83 are located at the distance "A" which is required for maximum efficiency of cooling action of the water under its normal utilization pressure. However, if the grinding wheel undergoes a reduction in diameter as a result of wear, the interval "A" becomes too large. In order to reduce this interval, the shoe 14 is brought closer to the grinding wheel by rotating the screw 46 through the desired angle. At the same time, the screw 49 rotates through the same angle and its pitch has been so determined as to ensure that the apex of the flexible strip 82 is brought close to the shoe 84 of the U-section support. This consequently produces a decrease in radius of curvature of the deformable strip which corresponds exactly to the reduction in radius of curvature of the active surface of the grinding wheel. The value of the interval "A" is therefore maintained over the entire active surface.

In the example which is illustrated, the active surface 2A of the grinding wheel has a profile such as to form projections and hollow portions of substantial depth whilst the teeth 24 of the blocks 83 have a profile which corresponds to that of the grinding wheel. The structure of the present embodiment with rigid blocks carried by a deformable strip is particularly well suited to these deep surface depressions since the blocks do not need to undergo deformations and it is nevertheless possible in practice to obtain a general active surface having a variable radius of curvature. However, the same arrangement would of course be equally applicable to the case of cylindrical or non-profiled grinding wheels.

As can readily be understood, the invention is not limited to the embodiments described in the foregoing with reference to the accompanying drawings. Depending on the applications which may be contemplated, a large number of modifications can accordingly be made without thereby departing either from the scope or the spirit of the invention.

I claim:

1. A sprinkling device for grinding wheels and like tools having a guard and a generally cylindrical active surface, said sprinkling device comprising a hollow deflecting shoe to be connected to a source of pressure sprinkling liquid, said hollow deflecting shoe having a U-shaped rigid body forming two cheeks and a deformable deflecting surface extending between said cheeks with a curvature located opposite to said active surface of said grinding wheel, said deflecting surface having two curved ends secured to said rigid body thus forming a chamber, said deflecting surface having sprinkling liquid exit apertures and teeth oriented substantially at right angles to the displacement of said active surface of said grinding wheel in order to turn said sprinkling liquid toward said grinding wheel; central supporting and adjusting means carried by the guard and operatively associated with said U-shaped rigid body for supporting and adjusting said shoe toward and away from said grinding wheel; and central curvature adjusting screw means carried by said U-shaped rigid body operatingly connected to the central portion of said deflecting surface of said shoe for adjusting the curvature of said deflecting surface according to the diameter of said grinding wheel.

2. The device of claim 1, wherein said supporting and adjusting means and said curvature adjusting screw means are operatively connected to each other.

3. A sprinkling device for grinding wheels and like tools having a guard and a generally cylindrical active surface, said sprinkling device comprising a hollow deflecting shoe to be connected to a source of pressure sprinkling liquid, said hollow deflecting shoe having a U-shaped rigid body forming two cheeks and a deformable deflecting surface extending between said cheeks with a curvature located opposite to said active surface of said grinding wheel, said deflecting surface having two curved ends secured to said rigid body thus forming a chamber, said deflecting surface having sprinkling liquid exit apertures and teeth oriented substantially at right angles to the displacement of said active surface of said grinding wheel in order to turn said sprinkling liquid toward said grinding wheel; supporting and adjusting means carried by the guard for supporting and adjusting said shoe toward and away from said grinding wheel; and curvature adjusting screw means operatively connected to the central portion of said deflecting surface of said shoe for adjusting the curvature of said deflecting surface according to the diameter of said grinding wheel, said supporting and adjusting means and said curvature adjusting screw means being operatively connected with each other and comprising a screw with differential threads.

4. A sprinkling device for grinding wheels and like tools having a guard and a generally cylindrical active surface, said sprinkling device comprising a hollow deflecting shoe to be connected to a source of pressure sprinkling liquid, said hollow deflecting shoe having a U-shaped rigid body forming two cheeks and a deformable deflecting surface extending between said cheeks with a curvature located opposite to said active surface of said grinding wheel, said deflecting surface having two curved ends secured to said rigid body thus forming a chamber, said deflecting surface having sprinkling liquid exit apertures and teeth oriented substantially at right angles to the displacement of said active surface of said grinding wheel in order to turn said sprinkling liquid toward said grinding wheel; supporting and adjusting means carried by the guard for supporting and adjusting said shoe toward and away from said grinding wheel; and curvature adjusting screw means operatively connected to the central portion of said deflecting surface of said shoe for adjusting the curvature of said deflecting surface according to the diameter of said grinding wheel, said deformable deflecting surface being formed by a strip of resiliently deformable material lined with an array of rigid blocks fixed in adjacent relation onto said strip, said teeth being provided on the faces of said blocks remote from said strip, and said blocks having further apertures in register with said sprinkling liquid exit apertures.

5. The device of claim 4, wherein said faces of said blocks remote from said strip have a non-uniform cross-section mating with a non-uniform profile of said grinding wheel.

6. The device of claim 4, wherein said blocks are secured to said strip by means of screws pierced axially to provide for said further apertures.

* * * * *